United States Patent [19]

Akimoto et al.

[11] Patent Number: 4,955,426

[45] Date of Patent: Sep. 11, 1990

[54] PRESSING MECHANISM FOR CASTING APPARATUS

[75] Inventors: Haruo Akimoto, Yamaguchi; Kunio Takeya, Tokyo, both of Japan

[73] Assignee: Ube Industries, Ltd., Japan

[21] Appl. No.: 378,164

[22] Filed: Jul. 11, 1989

[30] Foreign Application Priority Data

Jul. 26, 1988 [JP] Japan ..... 63-184515

[51] Int. Cl.[5] ..... B22D 18/02; B22D 27/11

[52] U.S. Cl. ..... 164/314; 164/312; 164/319

[58] Field of Search ..... 164/312, 314, 319, 120, 164/113

[56] References Cited

U.S. PATENT DOCUMENTS 1,932,865 4/1960 Bauer ..... 164/312

FOREIGN PATENT DOCUMENTS 58-196159 11/1983 Japan ..... 164/312

63-108957 5/1988 Japan ..... 164/312

*Primary Examiner*—Kuang Y. Lin

*Attorney, Agent, or Firm*—Kanesaka and Takeuchi

[57] ABSTRACT

A pressing mechanism for a casting apparatus comprises: a mold including a cavity for solidifying molten metal therein and a biscuit portion and a runner portion for introducing the molten metal therethrough into the cavity; a unit for supplying molten metal into the cavity, the unit having a sleeve to store molten metal and capable of communicating to the runner and a plunger tip in the sleeve, the plunger tip being capble of protruding from the sleeve so that the molten metal is fed into the mold after the sleeve is communicated to the biscuit portion, the tip being capable of protruding into the biscuit portion; a feeding rod disposed in the mold for freely protruding into the runner; and a unit for reciprocating the feeding rod. The tip approaches to a ceiling surface of the biscuit to a range of 0.5 to 5 mm. The tip may have a projection at its top face.

17 Claims, 4 Drawing Sheets

PRESSING MECHANISM FOR CASTING APPARATUS

FIELD OF THE INVENTION AND RELATED ART STATEMENT

The present invention relates to a casting apparatus such as a diecasting machine accompanied by the injection of molten metal for casting metal and, more particularly, to a casting apparatus having its metal feeding unit improved.

In a casting apparatus such as a diecasting machine, the molten metal is fed from a pouring unit through a biscuit portion and runner of a mold unit to a cavity, in which it is solidified into a molding.

If this molding is made for a pressure-resistive article to be made without void, th.e cavity is pushed directly with a feeding rod after the end of the charge of the molten metal to afford the feeding effect so as to disperse the void. This feeding effect can also be given by making the injection plunger tip of a double construction composed of an outer tip and an inner tip.

This diecasting machine is disclosed in Japanese Patent Publication Nos. 59 - 13492, 58 - 55858, 59 - 30503, 60 - 2947, 4 - 31325, 47 - 18975 and 51 - 34809 and Japanese Utility Model Publication No. 44 - 29055. In case the runner which leads the biscuit portion to the cavity is pushed directly with the feeding rod while the molten metal in the cavity is not solidified, the injection plunger is pushed back by the displacement of the feeding rod, so that the feeding effect cannot be given. If, on the other hand, the pushing timing is late for the direct push of the cavity, the molten metal is solidified so that the feeding rod cannot be pushed even by a considerable force. Even if pushing can be made the molding is cracked to become defective.

In the diecasting machine for giving the feeding effect by the double construction of the plunger tip of the inner and outer tips, on the other hand, the outer tip is retracted by the displacement of the advance of the inner tip to give no feeding effect if the inner tip is protruded at an early stage after the end of the charge of the molten metal, because the molten metal is not solidified to a proper level. Since, moreover, the inner tip slides on the inner circumference of the outer tip, the plunger tip has to be sufficiently cooled for preventing the seizure. For protecting the cooling portion the plunger tip diameter have to be increased more than necessary, so that the cost for constructing the apparatus rises for nothing.

OBJECT AND SUMMARY OF THE INVENTION

The present invention has an object to provide a casting apparatus which can afford the feeding effect reliably no matter what the state of the molten metal in the mold might be. Another object of the present invention is to provide a casting machine which can make a casting of excellent quality.

A further object of the present invention is to provide a casting apparatus which can be operated under a low casting pressure, so that it can be constructed at a low cost because the feeding effect is only required for charging the cavity.

According to the first aspect of the present invention, there is provided a pressing mechanism of a casting apparatus comprising: a mold including a cavity for solidifying molten metal therein and a runner portion and a biscuit portion for introducing the molten metal therethrough into the cavity; a unit for supplying molten metal into the cavity, the unit having a sleeve to store molten metal and capable of communicating to the biscuit portion and a plunger tip in the sleeve, the plunger tip being capable of protruding from the sleeve so that the molten metal is fed into the mold after the sleeve is communicated to the biscuit portion, the tip being capable of protruding into the biscuit portion fully so that a front end of the tip approaches closely in a range of 0.5 to 5 mm to a ceiling surface of the biscuit portion; a feeding rod disposed in the mold for protruding into the runner portion; and a unit for reciprocating the feeding rod. The runner portion has a sectional area which is "n" times as small as a sectional area of the plunger tip, wherein "n" is a ratio of feeding pressure to injecting pressure.

According to the second aspect of the invention, there is provided a mechanism comprising: a mold including a cavity for solidifying molten metal therein and a runner portion and a biscuit portion for introducing the molten metal therethrough into the cavity; a unit for supplying molten metal into the cavity, the unit having a sleeve to store molten metal and capable of communicating to the biscuit portion and a plunger tip in the sleeve, the plunger tip being capable of protruding from the sleeve so that the molten metal is fed into the mold after the sleeve is communicated to the biscuit portion, the tip being capable of protruding into the biscuit portion fully so that a front end of the tip approaches closely to a ceiling surface of the biscuit portion; a feeding rod disposed in the mold for protruding into the runner portion; and a reciprocator of the feeding rod. The plunger tip has a ring-shaped projection projecting from a top face thereof, so that the plunger tip is pushed back at only a limited area of the top face when the feeding rod is protruded after the cavity is filled with the molten metal.

The third embodiment provides a mechanism comprising: a mold including a cavity for solidifying molten metal therein and a runner portion and a biscuit portion for introducing the molten metal therethrough into the cavity; a unit for supplying molten metal into the cavity, the unit having a sleeve to store molten metal and capable of communicating to the biscuit portion and a plunger tip in the sleeve, the plunger tip being capable of protruding from the sleeve so that the molten metal is fed into the mold after the sleeve is communicated to the biscuit portion, the tip being capable of protruding into the biscuit portion fully so that a front end of the tip approaches closely to a ceiling surface of the biscuit portion; a feeding rod disposed in the mold for protruding into the runner portion; and a reciprocator of the feeding rod. The plunqer tip has a plug-shaped projection projecting from a top face thereof which is capable of entering into a lower part of the runner portion, so that the plunger tip is pushed back at only a limited area of the top face when the feeding rod is protruded after the cavity is filled with the molten metal.

In the casting apparatus of the invention, the mold may include a stationary mold and a movable mold adapted to be coupled to the stationary mold. The stationary mold and the movable mold define the cavity, the runner and the biscuit portion when they are coupled to each other. Likewise, the molten metal feeding unit may include a plunger tip adapted to be reciprocated by an injection cylinder and a sleeve fitting the plunger tip slidably therein. The molten metal is injected into the cavity through the runner portion by the forward movement of the plunger tip. Moreover, the feeding rod may preferably be reciprocated by a cylinder mechanism and may be disposed in the stationary mold.

In the invention, a portion other than the product is preferable to be pushed by the feeding rod in any of the mode, so that the product is prevented from being flawed. Since, moreover, the pouring unit such as the injection cylinder need not give the feeding effect but may charge the cavity, it is sufficient to provide a low pouring pressure so that the cost for constructing the apparatus can be dropped.

Their runner portion may be provided with a channel section where the sectional area is smaller than any other section of the runner portion, so that the backward force given by the protrusion of the feeding rod is reduced.

In the present mechanism, after the cavity has been charged up with the molten metal by moving the plunger tip, the feeding rod is pushed into the cavity or the runner portion to afford the feeding effect.

According to the mechanism of the invention, the feeding pressure pushes back the plunger tip at a limited part of the top face thereof, so that the tip does not retract while the feeding rod is being protruded. As a result, a feeding effect is given to the molten metal sufficiently, and a product is produced with good quality. Furthermore, in the invention, the molten metal pouring unit does not need to be so constructed that it may give feeding effect, but it requires only pouring function, whereby it may be constructed with low cost and it reduces cost for injection.

PREFERRED EMBODIMENTS

Figure 1:
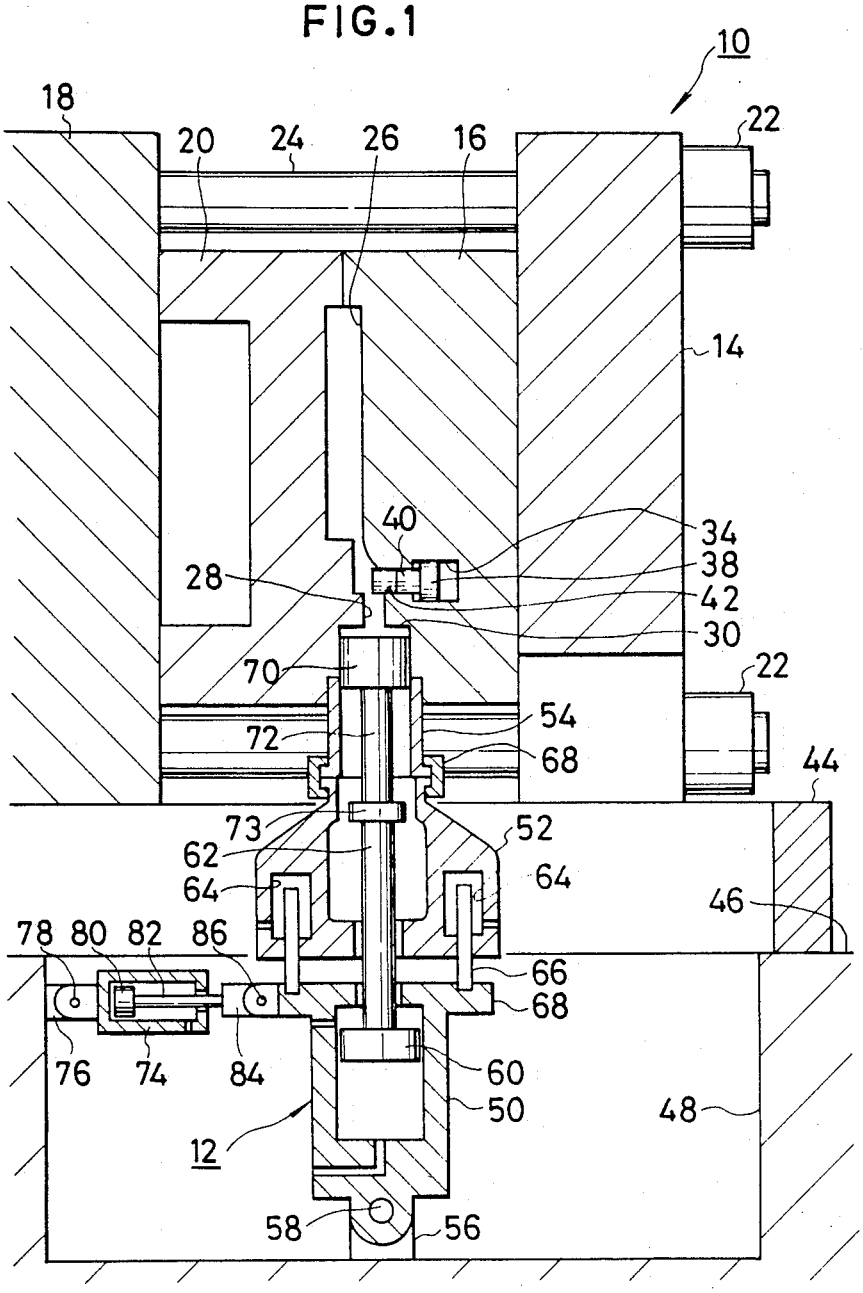
FIG. 1 is a vertical section view showing a casting apparatus according to an embodiment of the present invention.

The present invention will be described in detail in the following in connection with the embodiments thereof with reference to the accompanying drawings A casting apparatus according to an embodiment of the present invention is constructed mainly of a molding unit 10 and a pouring unit 12. The molding unit 10 is equipped with a stationary mold 16 held on a stationary board 14 and a movable mold 20 held on a movable board 18. The stationary board 14 has a column 24 connected thereto through nuts 22, and the movable board 18 is made movable toward and apart from the stationary board 14 along the column 24 by the action of a not-shown toggle mechanism.

The stationary mold 16 and the movable mold 20 form in its mating faces a cavity 26, a runner portion 28 and a biscuit portion 30.

The stationary mold 16 is formed with a cylinder bore 34 in which a piston 38 is provided to reciprocate. A feeding rod 42 is connected to the piston 38 at its rear end, so that it may protrude into the runner portion 28 by advance of the piston 38.

The molding unit 10 is placed on a machine base 44, which in turn is disposed to cross a pit 48 formed by recessing a ground base 46.

The pouring unit 12 is disposed in the pit 48. This pouring unit 12 is constructed of an injection cylinder 50, a block 52 and a sleeve 54 sequentially upward in the recited order. The injection cylinder 50 is hinged through a pin 58 to a seat 56, which is anchored to the bottom of the pit 48, so that its upper end can be inclined on the pin 58. In the injection cylinder 50, there is reciprocated a piston 60 to which is connected an upwardly extending rod 62.

The block 52 is formed with vertically extending cylinder bores 64, into which are inserted docking rams 66 having their lower ends anchored to a flange 68 formed on the top surface of the injection cylinder 50.

The sleeve 54 is connected through a connecting member 68 to the upper side of the block 52 and has its upper end fitted in the lower end of the biscuit 30 of the molding unit 10. The plunger tip 70 is set slidably in the sleeve 54 so that it may move up and down.

A plunger 72 which holds the plunger tip 70 is connected at its lower end to the upper end of the rod 62 through a coupling 73.

To the side wall of the pit 48, there is hinged through a seat 76 and a pin 78 an inclining cylinder 74 which has its piston 80 connected to a rod 82. This rod 82 has its leading end hinged to the side of the flange 68 of the injection cylinder 50 through a coupling 84 and a pin 86.

The operations of the casting apparatus thus constructed will be described in the following.

When the oil pressure is released from the cylinder bores 64, the block 52 drops until it seats upon the cylinder 50. When, on the other hand, the oil pressure is released from the head end of the injection cylinder 50, the piston 60 drops together with the plunger tip 70 to their lower limits. If in this position, the rod 82 of the inclining cylinder 74 is protruded, the pouring unit 12 is inclined in its entirety. Then, a molten metal is poured into the sleeve 54.

After this, the rod 82 of the inclining cylinder 74 is retracted to return the pouring unit 12 to the upright position. Next, the oil pressure is introduced into the cylinder bores 64 of the block 52 to protrude the docking rams 66. As a result, the block 52 is raised to insert the sleeve 54 into the biscuit portion 30 of the molding unit 10.

Then, the oil pressure is introduced into the head-end side of the injection cylinder 50 to raise the piston 60. As a result, the plunger tip 70 is raised to introduce the molten metal reserved in the sleeve 54 into the cavity 26 through the biscuit portion 30 and the runner 28.

After or alternatively just before the cavity 26 is fully charged up with the molten metal, the feeding rod 42 is projected into the runner portion 28 by introducing the oil pressure into the head-end side of the cylinder bore 34 and advancing the piston 38 whereby a feeding effect can be attained.

After the solidification of the molten metal in the cavity has ended, the movable board 18 is retracted to open the mold, and the cost product is pushed out by a pushing device (although not shown) which is carried on the movable mold 20. The pushing device is called a knock out or an ejector.

Incidentally, prior to this mold opening step, the piston 60, the block 52 and so on are dropped to their lower limits and prepared for the subsequent casting process.

Figure 2:
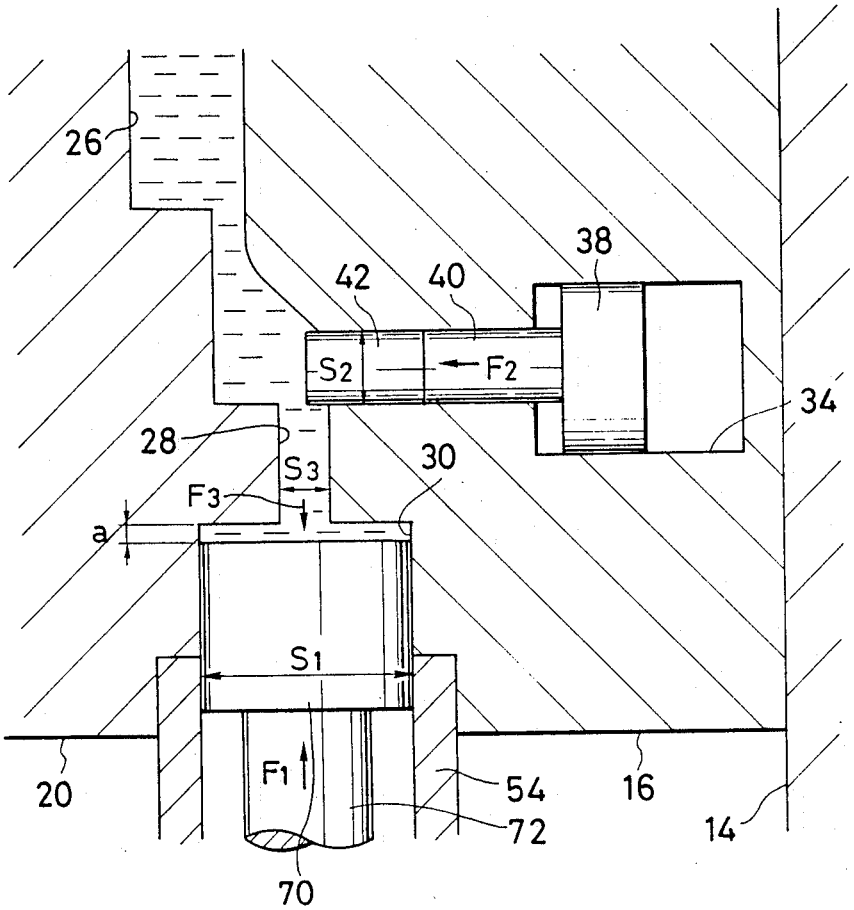
FIG. 2, is a view for explaining the operations of the casting apparatus of FIG. 1.

As shown in FIG. 2, the plunger tip 70 has a sectional area $S_1$, the feeding rod 42 has a sectional area $S_2$ and the runner portion 28 has a sectional area $S_3$ where the molten metal passes therethrough. The plunger tip 70 is raised with force $F_1$ during injecting, and is kept to be pushed with the same force by the cylinder 50. The feeding rod is advanced with force F2 by displacement of piston 38. The plunger tip 70 is pushed back with force $F_3$ during the feeding when the feeding rod 42 is being protruded. The molten metal in the mold has injection pressure $P_A$ when the molten metal is injected, and has feeding pressure $P_B$ during the feeding.

The molten metal is almost Newtonian fluid during the injection since the temperature of the molten metal is sufficiently high, so that the molten metal in the mold is pushed with force $F_1$ ($F_1=P_A \cdot S_1$) and the feeding rod 42 is pushed with force $P_A \cdot S_2$ respectively. The molten metal is fed by the feeding rod 42 after a certain time has passed since the injection ended and just before the metal has almost solidified.

Feeding pressure $P_B$ is "n" times as high as the injection pressure $P_A$ (accordingly $P_B=n \cdot P_A$), wherein n is larger than 1 ($n>1$).

The molten metal becomes non-Newtonian fluid when it is cooled after the injection and solidifies to a certain level . Therefore, when the feeding rod 42 is protruded into the cooled molten metal to give feeding effect thereto, the molten metal in the mold does not push all of the area $S_1$ but only a part of an upper face (top face) of the plunger tip 70 which equals almost to the sectional area $S_3$ of the runner portion 28.

Accordingly, the plunger tip 70 is pushed back with force $F_3$ ($F_3=P_B \cdot S_3$) while the feeding rod 42 is protruded. In the invention, the apparatus is so constructed that the force $F_3$ is smaller than the afformentioned force $F_1$ of the injection. As a result, the plunger tip 70 does not retract when the feeding rod 42 is protruded, whereby the feeding effect can be sufficiently given to the molten metal in the cavity.

As described above, the area $S_3$ should be not more than $S_1/n$ ($S_3<S_1/n$) in the invention. This is introduced by the following:

The plunger tip 70 does not retract at all when the force $F_3$ is not more than $F_1$ ($F_3<F_1$). Wherein $F_1$ equals to $P_A \cdot S_1$ and $F_2$ to $P_B \cdot S_3$ ($F_1=P_A \cdot S_1$, $F_3=P_B \cdot S_3$), $P_B \cdot S_3$ is not more than $P_A \cdot S_1$ ($P_B \cdot S_3<P_A \cdot S_1$) and $S_3=S_1 \cdot P_A/P_B=S_1/n$ since $P_B/P_A$ equals to "n".

A gap "a" shown in FIG. 2 between the top face of the plunger tip 70 and the ceiling surface of the biscuit portion 30 when the tip 70 is raised to the upper limit should be in the range of 0.5 to 5 mm in the invention so that the molten metal pushes only a limited part of the top face of the tip 70 and not all of the face. When the gap "a" is larger than 5 mm, the molten metal in the runner portion 28 and the biscuit portion 30 is so hot that the fluid becomes Newtonian fluid whereby it pushes all of the top face of the tip 70. Should the gap "a" be smaller than 0.5 mm, the tip 70 may become in contact with a ceiling portion of the biscuit portion 30 when the tip 70 raises to the uppermost stroke end thereof.

Figure 3:
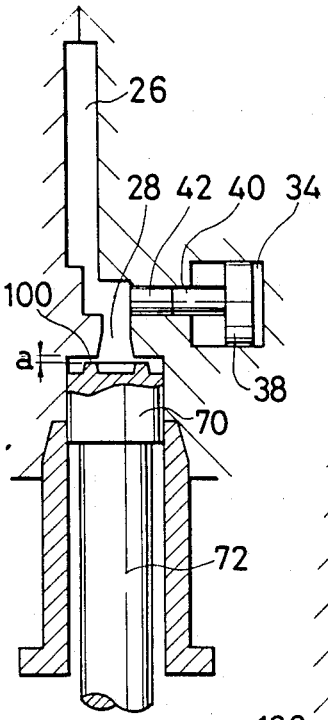
FIG. 3, 4, 5, 6 and 7 are vertical enlarged section views showing a main part of a casting apparatus according to other embodiments of the invention.
Figure 4:
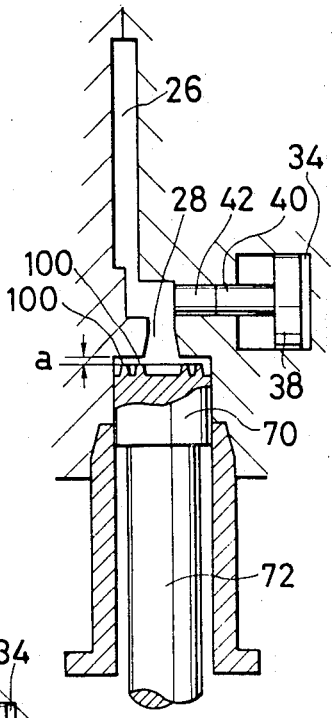
Figure 5:
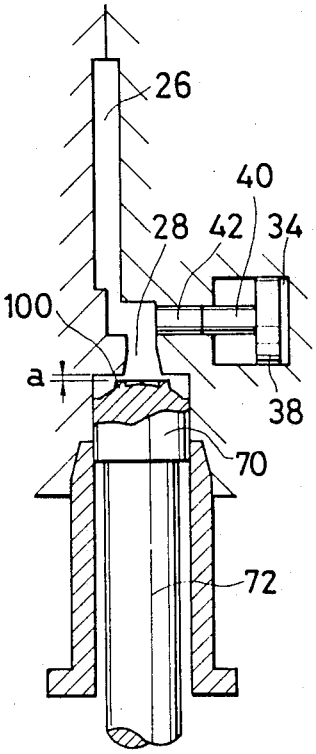

Other embodiments of the invention are described in FIGS. 3 to 5, wherein the plunger tip 70 is provided with a ring-shaped raised portion 100 rising from the top face thereof. The raised portion 100 limits the area where the metal fluid pushes back the tip 70 to projected area of $S_3$. FIG. 3 shows a single ring-shaped projection 100, FIG. 4 describes double ring-shaped projections 100 and FIG. 5 indicates a spherical or convex top face of the tip 72 with the projection 100 In every mode, "a" is preferably 0.5 to 5 mm.

Figure 6:
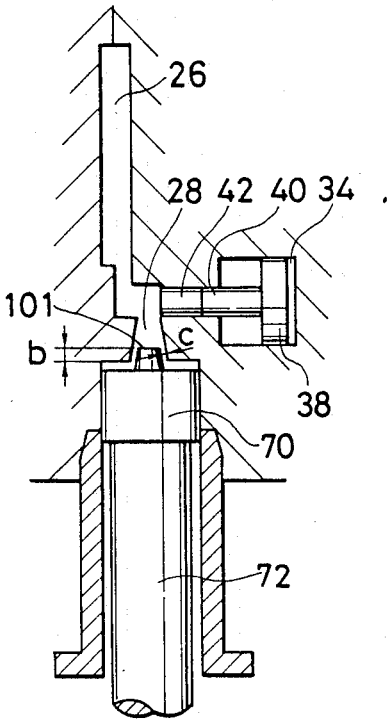
Figure 7:
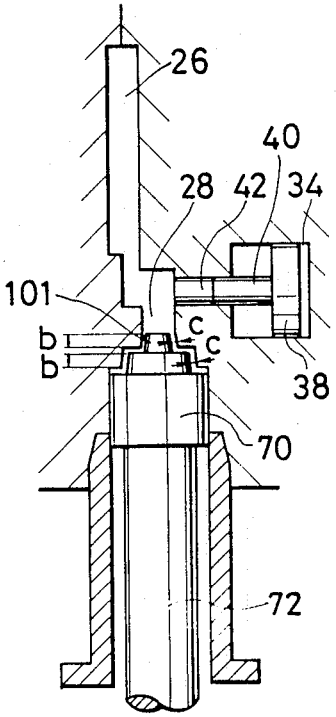

FIG. 6 and 7 show other embodiments. The tip 70 in FIG. 6 has a plug-shaped raised portion 101 rising from the top face thereof which has a shape corresponding to that of a lower part of the runner portion 28 so that it enters to the lower part when the tip 70 is pushed up to the upper limit. A double stepped plug-shaped portion 101 shown in FIG. 7 will make it sure to limit the area where the tip 70 is pushed back by the metal fluid to the projected area of $S_3$. Each of values of "b" and "c" described in FIGS. 6 and 7 is preferably 0.5 to 5 mm.

What is claimed is:

1. A pressing mechanism for a casting apparatus, comprising, a mold including a cavity for solidifying molten metal therein, a runner portion and a biscuit portion for introducing molten metal to the cavity through the runner portion, said runner and biscuit portions being arranged vertically to prevent slag in the molten metal from entering into the runner, means for supplying molten metal into said cavity, said means having a sleeve for storing molten metal and communicating with said biscuit portion, and a plunger tip situated in said sleeve, said plunger tip being able to protrude from said sleeve so that the molten metal is fed into the mold after the sleeve communicates with the biscuit portion, and means for feeding molten metal and having a feeding rod disposed in the mold for protruding into the runner portion and means for reciprocating the feeding rod, wherein the runner has a size of $S_3 \leqq P_A/P_b \cdot S_1$, in which $S_3$ is a sectional area of the runner, $P_A$ is injection pressure by the plunger tip, $P_B$ is feeding pressure by the feeding rod, and $S_1$ is a sectional area of the plunger tip.

2. A pressing mechanism of a casting apparatus according to claim 1, wherein said plunger tip is provided with a front end, said front end being able to approach to a ceiling surface of the biscuit portion in a range of 0.5 to 5 mm.

3. A pressing mechanism of a casting apparatus according to claim 1, wherein said means for reciprocating said feeding rod is a hydraulic cylinder.

4. A pressing mechanism of casting apparatus according to claim 1, wherein said mold includes: a stationary mold and a movable mold adapted to be coupled to said stationary mold, wherein said stationary mold and said movable mold define said cavity and said passage therebetween when they are coupled with each other.

5. A pressing mechanism for a casting apparatus, comprising, a mold including a cavity for solidifying molten metal therein, a runner portion and a biscuit portion for introducing molten metal to the cavity through the runner portion, means for supplying molten metal into said cavity, said means having a sleeve for storing molten metal and communicating with said biscuit portion, and a plunger tip situated in said sleeve, said plunger tip being able to protrude from said sleeve so that the molten metal is fed into the mold after the sleeve communicates with the biscuit portion, said plunger tip having a ring-shaped raised portion in the middle region of the plunger tip and extending upwardly from an upper surface of the plunger tip, said raised portion being situated outside and around a portion corresponding to the runner portion, and means for feeding molten metal and having a feeding rod disposed in the mold for protruding into the runner portion and means for reciprocating the feeding rod, said feeding rod, when protruded, pushing molten metal into the cavity and providing back pressure on the plunger tip substantially within the raised portion.

6. A pressing mechanism of a casting apparatus according to claim 5, wherein the runner has a size of $S_3 \leqq P_A/P_B \cdot S_1$, in which $S_3$ is a sectional area of the runner, $P_A$ is injection pressure by the plunger tip, $P_B$ is feeding pressure by the feeding rod, and $S_1$ is a sectional area of the plunger tip.

7. A pressing mechanism of a casting apparatus according to claim 5, wherein said runner and biscuit portions are arranged vertically to prevent slag in the molten metal from entering into the runner.

8. A pressing mechanism of a casting apparatus according to claim 5, wherein said means for reciprocating said feeding rod is a hydraulic cylinder.

9. A pressing mechanism of casting apparatus according to claim 5 wherein said mold includes: a stationary mold and a movable mold adapted to be coupled to said stationary mold, wherein said stationary mold and said movable mold define said cavity and said passage therebetween when they are coupled with each other.

10. A pressing mechanism for a casting apparatus, comprising, a mold including a cavity for solidifying molten metal therein, a runner portion and a biscuit portion for introducing molten metal to the cavity through the runner portion, said runner portion having at least one stepped recess therearound at a side of the biscuit portion, means for supplying molten metal into said cavity, said means having a sleeve for storing molten metal and communicating with said biscuit portion, sand a plunger tip situated in said sleeve and having at least one raised portion extending from a top surface thereof, said plunger tip being cable to protrude from said sleeve so that the raised portion of the plunger tip enters into the stepped recess of the runner portion and the molten metal is fed into the mold after the sleeve communicates with the biscuit portion, and means for feeding molten metal and having a feeding rod disposed in the mold for protruding into the runner portion and means for reciprocating the feeding rod, said feeding rod, when protruded, pushing molten metal into the cavity and providing back pressure on the plunger tip substantially on the raised portion.

11. A pressing mechanism of a casting apparatus according to claim 10, wherein the runner has a size of $S_3 \leqq P_A/P_B \cdot S_1$, in which $S_3$ is a sectional area of the runner, $P_{A\ pl\ is\ injection\ pressure\ by\ the\ plunger\ tip,\ PB}$ is feeding pressure by the feeding rod, and $S_1$ is a sectional area of the plunger tip.

12. A pressing mechanism of a casting apparatus according to claim 10, wherein said runner and biscuit portions are arranged vertically to prevent slag in the molten metal from entering into the runner.

13. A pressing mechanism of a casting apparatus according to claim 10 wherein said means for reciprocating said feeding rod is a hydraulic cylinder.

14. A pressing mechanism of casting apparatus according to claim 10, wherein said mold includes: a stationary mold and a movable mold adapted to be coupled to said stationary mold, wherein said stationary mold and said movable mold define said cavity and said passage therebetween when they are coupled with each other.

15. A pressing mechanism of casting apparatus according to claim 4, wherein said feeding rod is disposed in one of the stationary mold and the movable mold.

16. A pressing mechanism of casting apparatus according to claim 9, wherein said feeding rod is disposed in one of the stationary mold and the movable mold.

17. A pressing mechanism of casting apparatus according to claim 14, wherein said feeding rod is disposed in one of the stationary mold and the movable mold.

* * * * *